US005561512A

United States Patent [19]

Fukano et al.

[11] Patent Number: 5,561,512

[45] Date of Patent: Oct. 1, 1996

[54] FIXATION CONTROL DEVICE

[75] Inventors: Masahiko Fukano; Toshiyuki Nakade; Shunsuke Konashi; Hiroshi Kageyama, all of Osaka, Japan

[73] Assignee: Mita Industrial Co. Ltd., Osaka, Japan

[21] Appl. No.: 573,065

[22] Filed: Dec. 15, 1995

[30] Foreign Application Priority Data

Jan. 11, 1995 [JP] Japan ..... 7-002880
Jan. 11, 1995 [JP] Japan ..... 7-002881

[51] Int. Cl.[6] ..... G03G 15/20

[52] U.S. Cl. ..... 355/285; 219/216

[58] Field of Search ..... 355/285, 290, 355/208; 219/216, 469; 432/59

[56] References Cited

U.S. PATENT DOCUMENTS 4,309,591 1/1982 Kanoto et al. ..... 219/216

FOREIGN PATENT DOCUMENTS 89-072187 9/1987 Japan .

*Primary Examiner*—Joan H. Pendegrass
*Assistant Examiner*—Quana Grainger
*Attorney, Agent, or Firm*—Beveridge, DeGrandi, Weilacher & Young, L.L.P.

[57] ABSTRACT

A fixation control device is provided which controls the operation of a fixing unit having a heat roller and a press roller between which a sheet is passed. When copies are successively made on a plurality of narrow-size sheets, the temperature of the end portions of the press roller rises and, therefore, the difference between the temperatures of the end portions and the central portion of the press roller becomes greater. The greater temperature difference results in a diameter difference between the central portion and the end portions of the press roller due to thermal expansion, thereby reducing sheet transportation ability of the heat roller and press roller. However, the fixation control device of the present invention can compensate the reduction in the transportation ability by increasing the rotational speed of the heat roller and press roller when the temperature difference becomes greater.

9 Claims, 10 Drawing Sheets

FIXATION CONTROL DEVICE

CROSS REFERENCE TO RELATED APPLICATIONS

This application claims priority benefits of Japanese Patent Applications No. 7-2880 (1995) and No. 7-2881 (1995) under 35 USC§119, the disclosure of said Japanese Patent Applications being incorporated herein by reference.

BACKGROUND OF THE INVENTION

1. Field of the Invention

The present invention relates to a fixation control device for controlling the operation of a fixing unit in an image forming apparatus such as an electrostatic copying machine.

2. Description of Related Arts

Recently, electrostatic copying machines capable of making a copy of a large-size document original such as of JIS A0 size have become available. "JIS A0 size", which is one of the sheet sizes (finished dimensions) specified by Japanese Industrial standards, is 841 mm×1189 mm.

Since it is difficult to handle large-size copy sheet such as of A0 size one by one, a roll sheet is generally used which is formed of an elongated continuous sheet wound around a roll core and installed in a copying machine.

In general, an electrostatic copying machine forms a copy image of a document original on a copy sheet in the following manner. The document original is scanned under light irradiation, and a photoreceptor is exposed to light reflected on the document original, whereby an electrostatic latent image is formed on the photoreceptor. The electrostatic latent image is developed into a toner image, which is then thermally fixed on a copy sheet in a fixing unit. Thus, a copy image of the document original is formed on the copy sheet.

The fixing unit has a rubber press roller and a heat roller heated by a heater and is adapted to thermally fix the toner image on the copy sheet passing between these rollers. The fixing unit should be heated up to a predetermined temperature for thermal fixation. In accordance with a conventional fixation temperature control method, the temperature of the heat roller is controlled to approach a predetermined temperature by detecting the temperature of the heat roller and switching on and off the heater based on the detected temperature.

Where copies are successively made on a plurality of narrow-size sheets such as of A2 size in a copying machine capable of copying a large-size document original such as of A0 size, the sheets passing between a heat roller and a press roller remove heat only from the longitudinally central portion of the heat roller and press roller and, thereafter, the temperature of the heat roller is maintained at a predetermined control temperature. However, the temperatures of the end portions of the heat roller and press roller become much higher than the control temperature because the sheets pass between the heat roller and the press roller without contacting the end portions thereof.

As a result, the diameters of the end portions of the rubber press roller are increased and thereby the contact pressure applied to the longitudinally central portion of the heat roller by the press roller is reduced. This reduces the sheet transportation ability of the heat roller and press roller as a whole.

Accordingly, a sheet is transported by the heat roller and press roller at a speed different from a speed at which the sheet is transported by transportation rollers provided on the upstream side thereof along a transportation direction, and slacks before the heat roller and press roller. This causes the sheet to be offset from an image transfer position of a photoreceptor, resulting in a transfer offset.

This problem is not limited to the aforesaid copying machine for copying a large-size document original, but may occur in a copying machine adapted to copy document originals of various sizes.

SUMMARY OF THE INVENTION

It is, therefore, an object of the present invention to provide a fixation control device which can prevent the occurrence of a transfer failure due to reduction in the transportation ability of a fixing unit.

According to one aspect of the present invention, to achieve the aforesaid object, there is provided a fixation control device comprising: a fixing unit having a press roller and a heat roller heated by a heater for thermally fixing toner on a sheet passing between the press roller and the heat roller;

driving means for rotatively driving the heat roller and the press roller;

center temperature detection means for detecting the temperature of the longitudinally central portion of the press roller;

end temperature detection means for detecting the temperature of an end portion of the press roller;

and control means for controlling the driving means based upon a comparison of the temperature detected by the center temperature detection means with the temperature detected by the end temperature detection means to control the rotational speed of the heat roller and press roller.

In the above-described aspect, the reduction in the transportation ability of the heat roller and press roller, which would occur due to the temperature difference between the end portion and the central portion of the press roller, can be compensated by controlling the rotational speed of the heat roller and press roller based upon the comparison between the temperatures of the end portion and central portion of the press roller. Therefore, the transfer offset due to the reduction in the transportation ability can be prevented.

The control means preferably controls the driving means to rotate the heat roller and press roller at a rotational speed higher than usual when a difference between the temperature detected by the center temperature detection means and the temperature detected by the end temperature detection means is greater than a predetermined threshold.

In accordance with preferred mode of the present invention, the fixation control device further comprises cooling means for supplying air to the press roller to cool the press roller, wherein if conditions including that the difference between the temperature detected by the center temperature detection means and the temperature detected by the end temperature detection means is greater than the predetermined threshold are satisfied, the control means selects a cooling mode in which the cooling means is driven in a state where the power to the heater is switched off and the driving of the driving means is stopped.

In the fixation control device with the aforesaid mode, when the temperature of the end portion of the press roller rises and the temperature difference between the end portion and the central portion of the press roll becomes greater as a result of successive toner fixation on a plurality of narrow-size sheets, the press roller is cooled by means of the cooling fan in the state where the power to the heater is switched off and the rotation of the heat roller and press roller is stopped. Thus, the temperatures of the central portion and the end portion of the press roller can be kept substantially the same, thereby preventing the reduction in the transportation ability to prevent the occurrence of a transfer offset. Further, since the central portion and the edge portions of the press roller are uniform in temperature, the diameters of the end portions and the central portion of the press roller are kept substantially the same. Therefore, when a wide-size sheet is passed between the heat roller and the press roller, the sheet will not be wrinkled.

DETAILED DESCRIPTION OF THE PREFERRED EMBODIMENT

An embodiment of the present invention will hereinafter be described with reference to the attached drawings.

Figure 1:
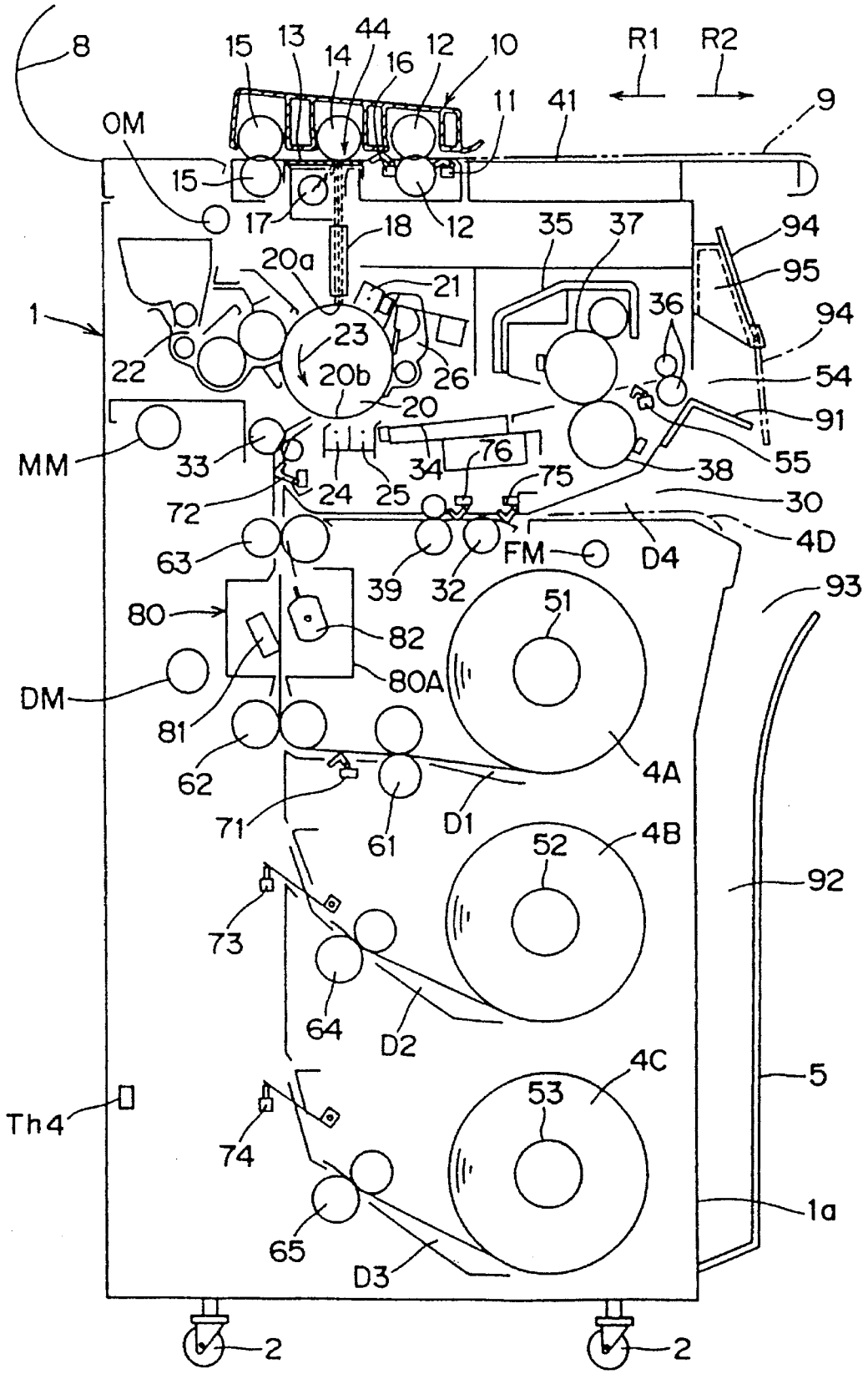
FIG. 1 is a schematic sectional view illustrating the internal construction of a copying machine including a fixation control device in accordance with one embodiment of the present invention.
Figure 2:
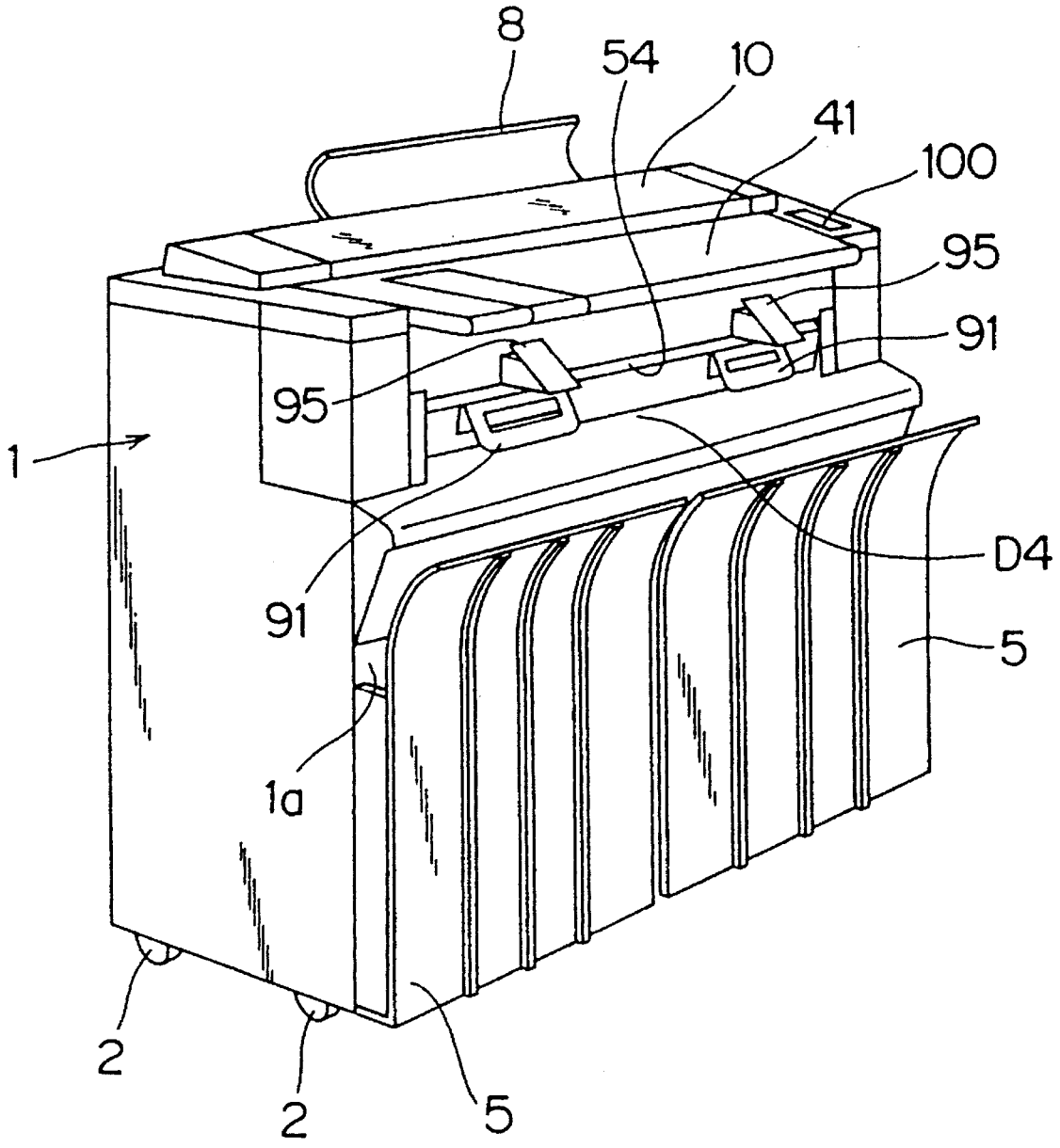
FIG. 2 is a perspective view illustrating the exterior construction of the copying machine.
Figure 3:
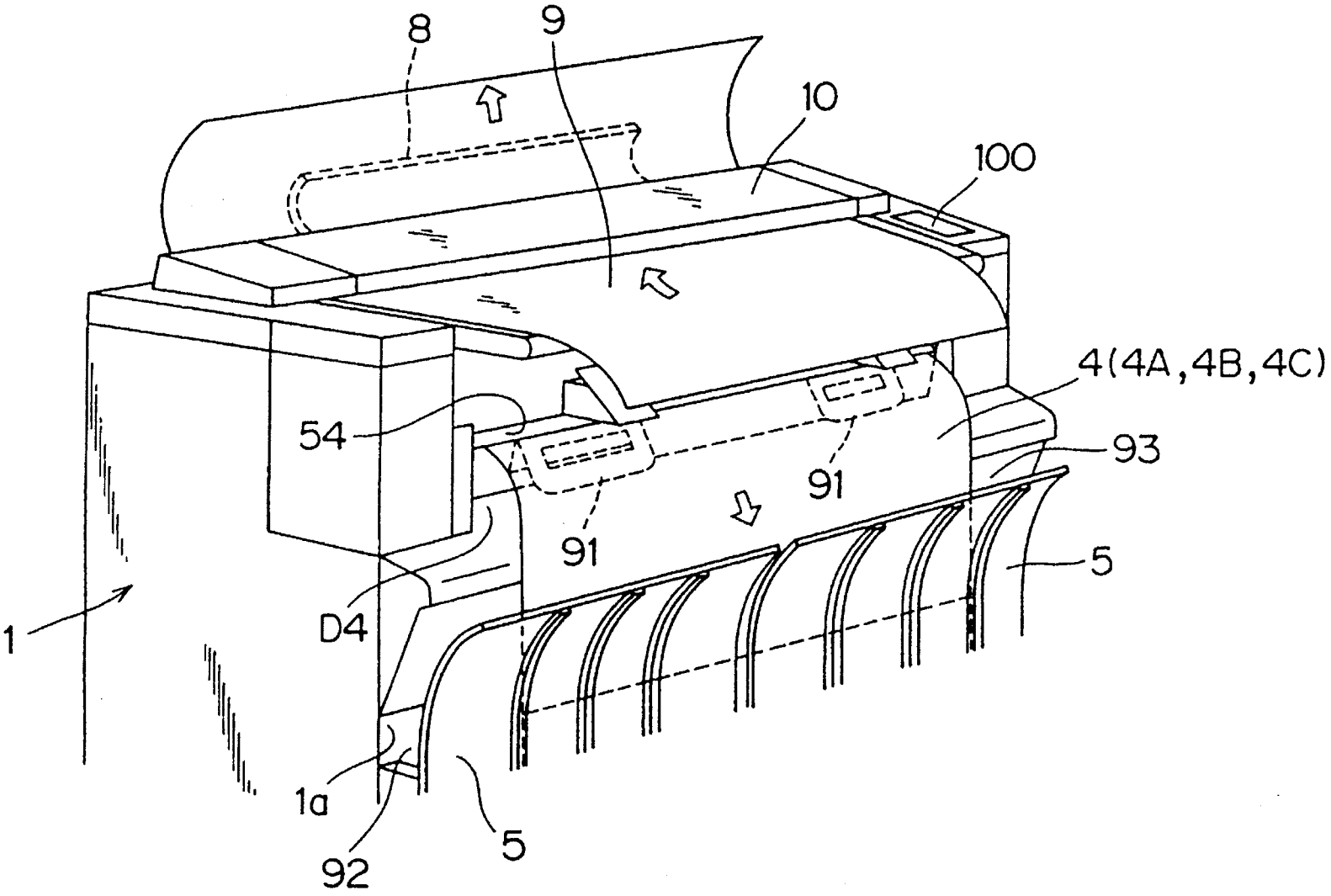
FIG. 3 is a perspective view illustrating the copying machine in its operation.

FIG. 1 is a schematic sectional view illustrating the internal construction of a copying machine in accordance with one embodiment of the present invention. FIG. 2 is a perspective view illustrating the external construction of the copying machine, and FIG. 3 is a perspective view illustrating the appearance of the copying machine which is performing a copying operation. The copying machine is adapted to obtain an image of a large-size document original such as of A0 size. In the copying machine, the document original is scanned under light irradiation by a stationary optical system while being transported, and an image is formed based upon the optical scanning.

Referring to FIG. 1, a machine body 1 has caster wheels 2 on the under side thereof for free movement. Referring to FIGS. 1 to 3, a document-original transportation section 10 is provided on the machine body 1 for transporting a document original 9 along a document-original transportation path 41 formed on the top face of the machine body 1. A discharge port 54 for discharging a sheet having a toner image transferred thereon opens in a front face la of the machine body 1. The sheet discharged from the discharge port 54 is guided by guide members 91, dropped through a guide opening 93 with the leading edge thereof oriented downward, and accommodated in a pocket 92 defined by a front cover 5 provided along the front face 1*a* of the machine body 1, as shown in FIG. 3. On an edge portion of the top face of the machine body 1 is provided with an operation section 100 having switches, keys and the like for making various settings related to a copying operation.

Figure 9:
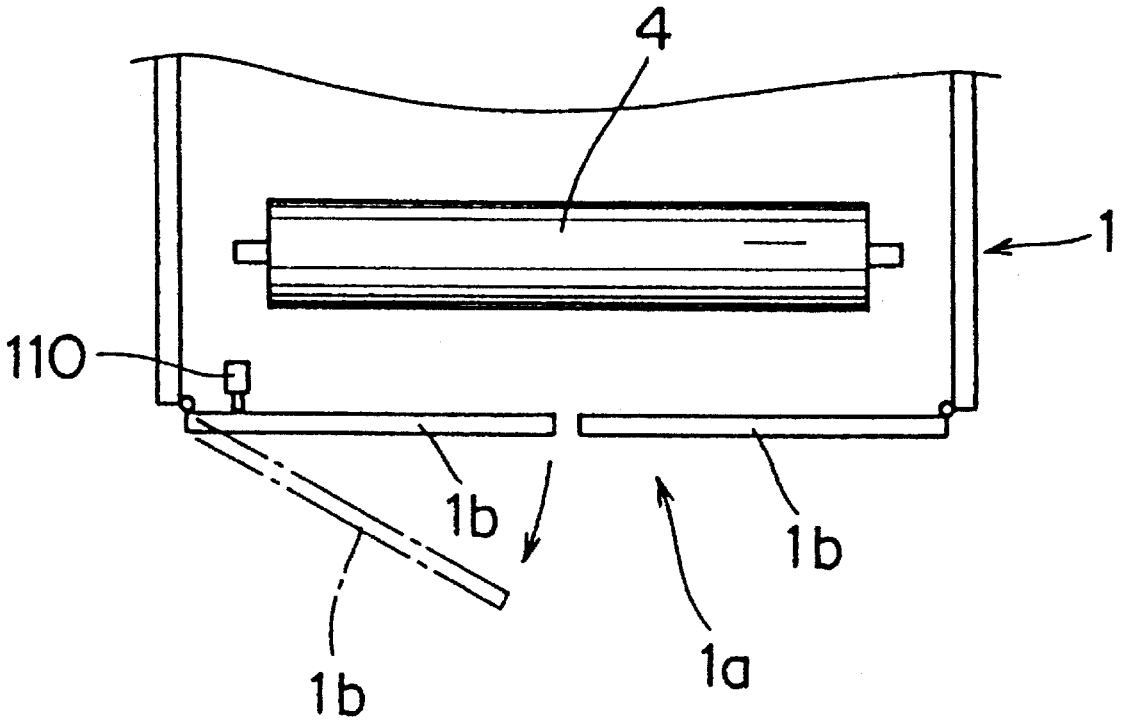
FIG. 9 is a schematic plan view illustrating the open state and close state of a front door of the copying machine.

Referring to FIG. 1, three roll sheets 4A, 4B and 4C which are located vertically in upper, middle and lower positions and each wound into a roll shape are accommodated within a portion between the vertically middle portion and the lower portion of the machine body 1. The roll sheets 4A, 4B and 4C are rolled around feed reels 51, 52 and 53, respectively. Examples of sheets to be used as these roll sheets 4A, 4B and 4C include normal paper, film and tracing paper. In the central portion of the machine body 1 is disposed a bypass transportation path D4 for feeding a cut-sheet preliminarily cut into a predetermined length such as of A0 size to A4 size through a manually sheet feeding section 30 provided on the front face 1*a* of the machine body 1. Referring to FIG. 9, at least a part of the front face 1*a* of the machine body 1 is formed into a front door 1*b* which is openable for replacement of the roll sheets 4A, 4B and 4C, and a front door open/close sensor 110 for detecting the open/close state of the front door 1*b* is provided inside the machine body 1. In FIG. 9, the front cover 5 defining the pocket 92 is not shown.

The roll sheet 4A in the upper position is transported along a first transportation path D1 to a photoreceptor drum 20 through the feed reel 51, sheet feeding rollers 61, a first leading-edge detection switch 71 for detecting the leading edge of the transported roll sheet 4A, transportation rollers 62, a cutter mechanism 80, transportation rollers 63, a second leading-edge detection switch 72 for detecting the leading edge of the transported sheet 4A, 4B, 4C or 4D, and transportation rollers 33 in this order. The roll sheet 4B in the middle position is transported along a second transportation path D2 to the photoreceptor drum 20 through the feed reel 52, sheet feeding rollers 64, a third leading-edge detection switch 73 for detecting the leading edge of the transported roll sheet 4B, the transportation rollers 62, the cutter mechanism 80, the transportation rollers 63, the second leading-edge detection switch 72, and the transportation rollers 33 in this order. The transportation path downstream of the transportation rollers 62 is common to the first transportation path D1. The roll sheet 4C in the lower position is transported along a third transportation path D3 to the photoreceptor drum 20 through the feed reel 53, sheet feeding rollers 65, a fourth leading-edge detection switch 74 for detecting the leading edge of the transported roll sheet 4C, the transportation rollers 62, the cutter mechanism 80, the transportation rollers 63, the second leading-edge detection switch 72, and the transportation rollers 33 in this order. The path downstream of the transportation rollers 62 is common to the first transportation path D1. The bypass transportation path D4 is a path which leads the cut-sheet 4D introduced from the manually sheet feeding section 30 to the photoreceptor drum 20 through a fifth leading-edge detection switch 75 for detecting the leading edge of the transported cut-sheet, a separation roller 32 for separating cut-sheets one from another by an abut plate (not shown) abutted against the cut-sheets, a sixth leading-edge detection switch 76 for detecting the leading edge of the transported cut-sheet, resist rollers 39, the second leading-edge detection switch 72 and the transportation rollers 33 in this order. The path downstream of the second leading-edge detection switch 72 in the bypass transportation path D4 is common to the first transportation path D1.

The cutter mechanism 80 has an elongated stationary blade 81 provided in a casing 80A and extending in a direction perpendicular to a transportation direction of the roll sheet 4A, 4B or 4C, and a rotary blade 82 cooperating with the stationary blade 81 to cut the transported roll sheet 4A, 4B or 4C therebetween. The roll sheet 4A, 4B or 4C is transported upward through the cutter mechanism 80.

The document-original transportation section 10 is adapted to switch the transportation direction to either a regular direction R1 or a reverse direction R2 for the transportation of the document original 9. The image forming operation is performed when the document original is transported in the regular direction R1. When a plurality of copies are made from one document original, the document-original transportation section 10 alternates the regular transportation direction R1 and the reverse transportation direction R2 to transport the document original. The document-original transportation path 41 is provided upstream the document-original transportation section 10 with respect to the regular direction R1 on the top face of the machine body 1 and laterally projects from the top face of the machine body 1.

The document-original transportation section 10 has a first document-original edge detection switch 11, first transportation rollers 12, a second document-original edge detection switch 16, a second transportation roller 14 and third transportation rollers 15 arranged along the regular transportation direction R1 in this order.

The first transportation rollers 12 are driven in response to the detection of the leading edge (on the downstream side in the regular transportation direction R1) of the document original 9 when the first document-original edge detection switch 11 is switched on. The second transportation roller 14 facing opposite to a transparent plate 13 for exposing the document original 9 to slit light serves to press the document original 9 against the transparent plate 13. The third transportation rollers 15 serve to discharge the document original 9 after the light exposure.

The second document-original edge detection switch 16 is switched on when the document original 9 is transported therethrough in the regular transportation direction R1, thereby detecting the leading edge (with respect to the regular direction R1) of the document original 9. In response to the switch on of the second document-original edge detection switch 16, the transportation of the roll sheet 4A, 4B or 4C (hereinafter referred to simply as "roll sheet 4", the term is used to explain the copying operation) is started, thereby coordinating the transportation of the roll sheet 4 with that of document original 9.

The first document-original edge detection switch 11 is switched off after the document original 9 is transported therethrough in the regular transportation direction R1, thereby detecting the tail edge (with respect to the regular direction R1) of the document original 9. The cutter mechanism 80 is driven at a preset time point a predetermined time period after the detection of the tail edge of the document original 9 to cut the roll sheet 4. In this embodiment, the length of the transportation path extending from the cutter mechanism 80 to an image transfer position 20*b* of a corona discharger for image transfer 24 is set longer than the length of the document-original transportation path extending from the first document-original edge detection switch 11 to a document-original light-exposure position 44 by a distance between the light exposure position 20*a* of the photoreceptor drum 20 and the image transfer position 20*b*, so that the tail edge of the sheet 4 cut at the preset time point can correspond to the tail edge of the document original 9 for image formation.

The second document-original edge detection switch 16 is switched off after the document original 9 is transported therethrough in the reverse transportation direction R2, thereby detecting the tail edge of the document original 9 transported in the reverse direction R2. In response to the switch off of the second document-original edge detection switch 16, the driving of the transportation rollers 12, 14 and 15 is stopped. At this time, the leading edge of the document original 9 is held between the transportation rollers 12 for the next copying operation. A reference numeral 8 denotes a reversion member for preventing the document original 9 from dropping to the rear side of the machine body 1 by reversing the transportation direction of the document original.

A stationary light source 17 for irradiating the document surface of the document original 9 is disposed in a predetermined relation with respect to the transparent plate 13. The light from the light source 17 is emitted onto the document surface through the transparent plate 13. The light reflected on the surface of the document original 9 is led to the surface of the photoreceptor drum 20 disposed in a generally central portion of the machine body 1 by means of a selfoc lens 18. Before being exposed to the light from the selfoc lens 18, the surface of the photoreceptor drum 20 is uniformly charged by a corona discharger 21 for electrostatic charging. After the light exposure, an electrostatic latent image corresponding to a document original image is formed on the surface of the photoreceptor drum 20. The electrostatic latent image is developed into a toner image by a developing unit 22. The toner image formed on the photoreceptor drum 20 is brought into the vicinity of the corona discharger 24 for image transfer, as the photoreceptor drum 20 is rotated in a direction indicated by the arrow 23.

On the other hand, the sheet 4 led to the photoreceptor drum 20 from the transportation path D1, D2 or D3 is led into the vicinity of the corona discharger for image transfer 24 with being brought into contact with the surface of the photoreceptor drum 20. Then, the toner image formed on the surface of the photoreceptor drum 20 is transferred onto the sheet 4 by way of corona discharge by the corona discharger for image transfer 24. The sheet 4 having the toner image transferred thereon is removed from the surface of the photoreceptor drum 20 by way of corona discharge by a corona discharger 25 for sheet removal, and then led to a fixing unit 35 through a transportation path 34. In the fixing unit 35, toner is fixed onto the surface of the sheet 4 by heat-pressing the sheet 4 between a heat roller 37 and a press roller 38. The sheet 4 on which the toner is fixed is discharged out of the machine body 1 through a discharge detection switch 55 and discharge rollers 36, guided by the guide members 91, and accommodated in the pocket 92, as described above. After the toner image is transferred, the toner remaining on the surface of the photoreceptor drum 20 is removed by a cleaning unit 26 for the next electrostatic latent image formation. Similarly, the cut-sheet 4D led to the photoreceptor drum 20 from the bypass sheet feeding path D4 is subjected to the toner image transfer and the toner fixation, and then discharged into the pocket 92.

Above each of the guide members 91 is disposed an auxiliary guide plate 94. The auxiliary guide plates 94 are respectively pivotally supported by stays 95 attached to the front face 1*a* of the machine body 1. The auxiliary guide plates 94 assume either an attitude (indicated by a dashed line in FIG. 1) for guiding the discharged sheet 4 hanging down forwardly of the guide members 91 into the pocket 92 cooperatively with the guide members 91 or an attitude (indicated by a solid line in FIG. 1) for sheet accommodation in which the auxiliary guide plates 94 are respectively supported by the stays 95. The attitude of the auxiliary guide plates 94 can be shifted by the pivotal movement thereof.

Image forming means is constituted by such members as the photoreceptor drum 20, the developing unit 22 and the corona discharger for image transfer 24. In this embodiment, the copying machine further includes a main motor MM for driving the image forming means, a sheet feeding motor DM for driving the transportation rollers for feeding the sheet 4A, 4B, 4C and 4D, a fixation motor FM for driving the heat roller 37 and press roller 38 of the fixing unit 35, and a document-original feeding motor OM for driving the document original transportation section 10.

Figure 4:
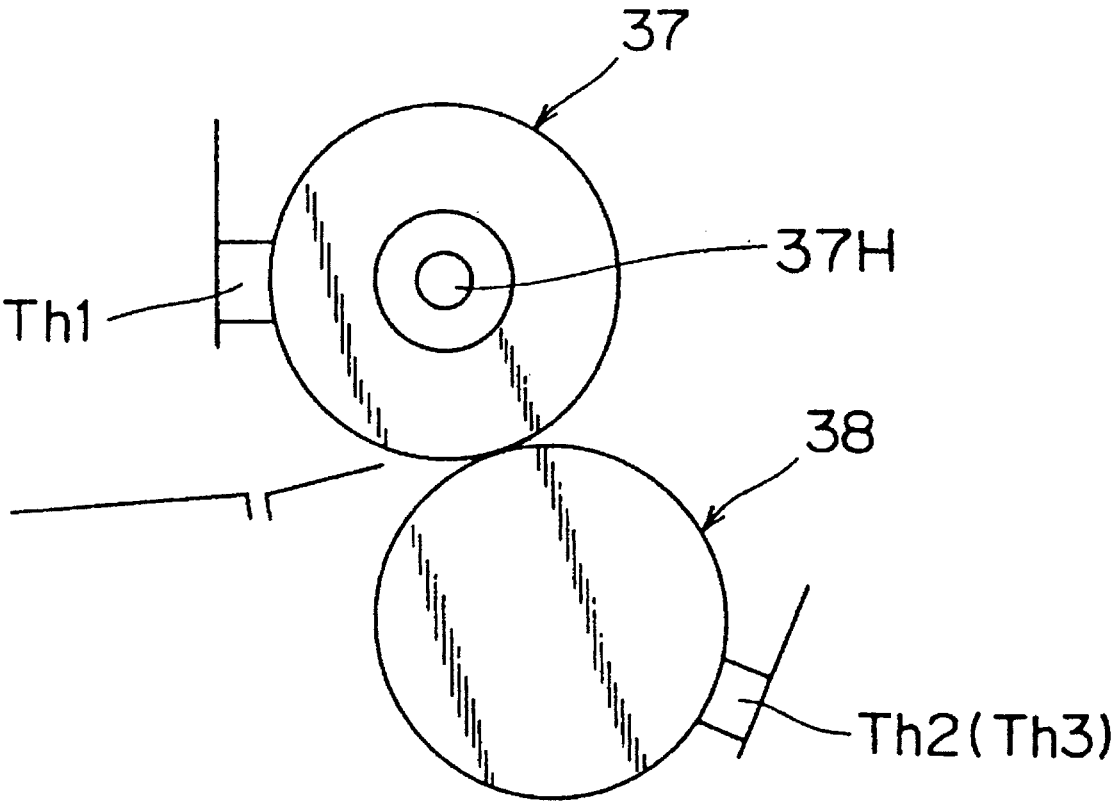
FIG. 4 is a schematic side view illustrating major portions of a fixing unit.
Figure 5:
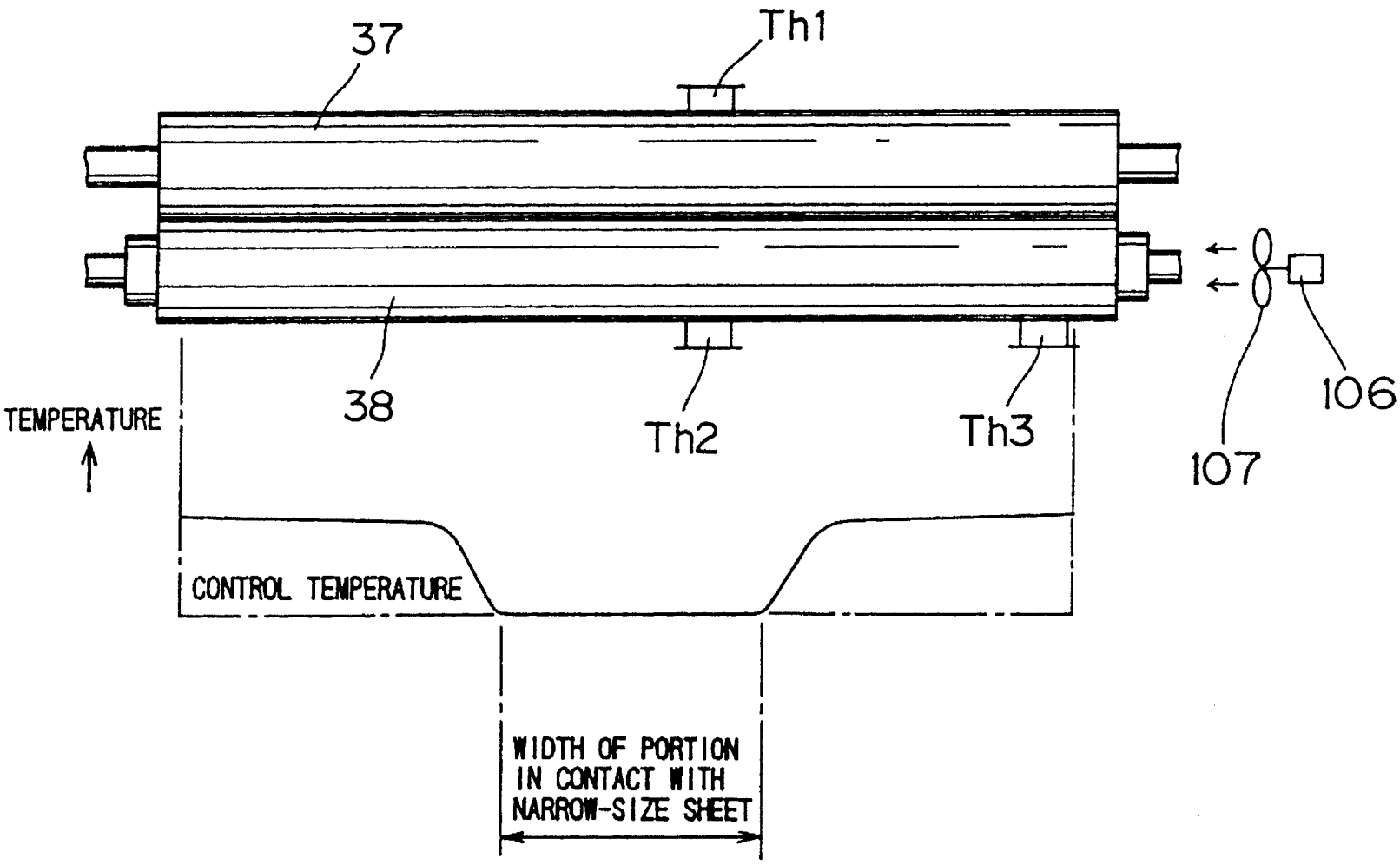
FIG. 5 is a schematic front view illustrating the major portions of a press roller with a distribution temperature.

Referring to FIG. 4, a heater 37H for heating the heat roller 37 is incorporated in the heat roller 37. Referring to FIG. 5, a cooling fan 107 for supplying air mainly to the press roller 38 is disposed adjacent one end of the press roller 38. The cooling fan 107 is driven by a fan motor 106. Referring to FIGS. 4 and 5, there are provided a first temperature sensor Th1 for detecting the temperature of the peripheral surface of the heat roller 37, a second temperature sensor Th2 serving as center temperature detection means for detecting the temperature of a longitudinally central portion of the peripheral surface of the press roller 38, and a third temperature sensor Th3 serving as end temperature detection means for detecting the temperature of one end portion of the peripheral surface of the press roller 38. A fourth temperature sensor Th4 for detecting the ambient temperature is provided in a position within the machine body 1 which is insusceptible to a thermal influence (see FIG. 1). The temperature sensors Th1, Th2, Th3 and Th4 each comprise a thermistor.

Figure 6:
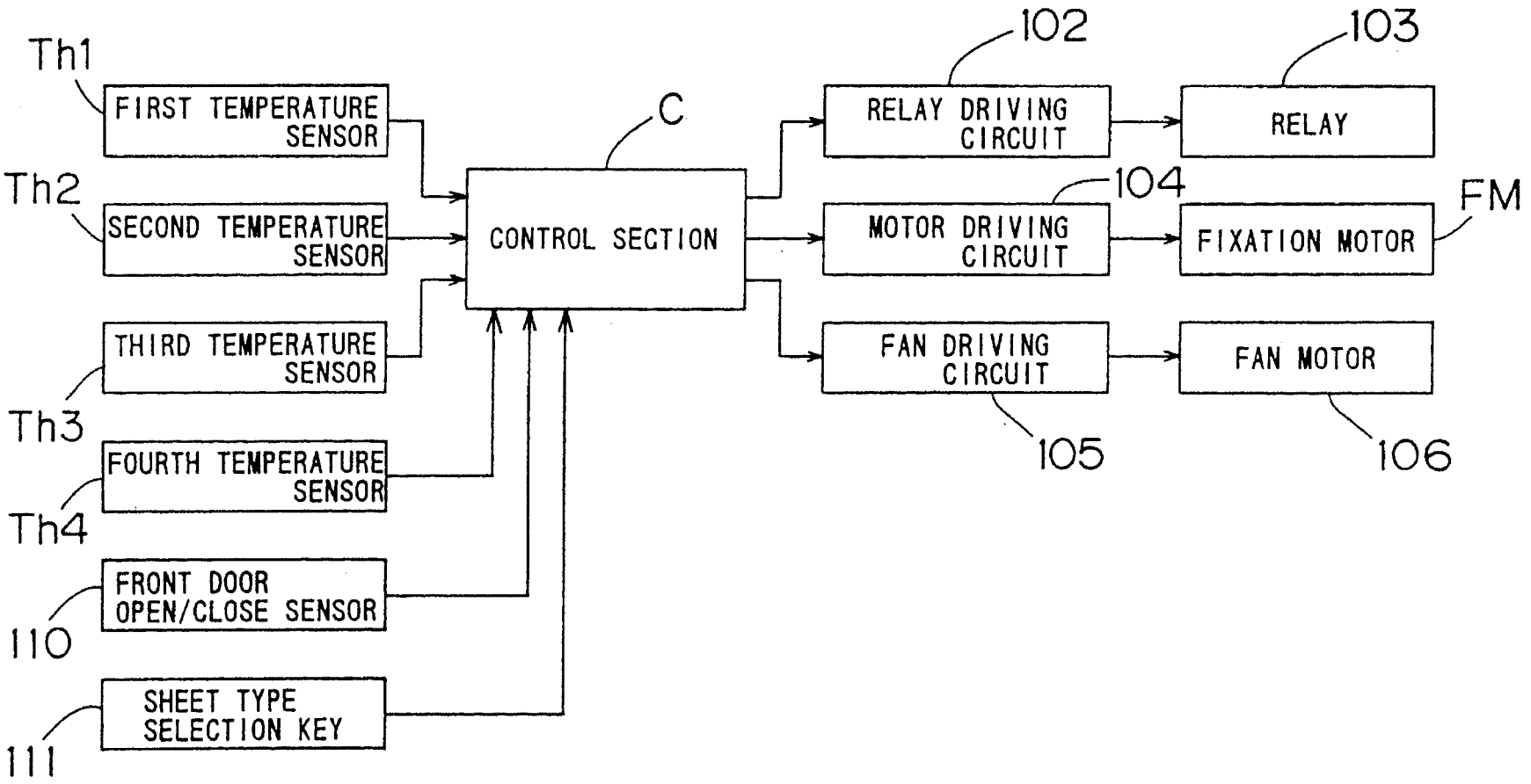
FIG. 6 is a block diagram illustrating the electrical construction mainly related to fixing operation of the copying machine.

Referring to FIG. 6 which is a block diagram illustrating the electrical construction of the copying machine mainly related to the fixing operation, the temperature sensors Th1, Th2, Th3 and Th4, the front door open/close sensor 110 and a sheet type selection key 111 provided on the operation section 100 (for selecting the sheet type from normal paper sheet, tracing paper sheet and film sheet respectively corresponding to the roll sheets 4A, 4B and 4C) are connected to a control section C comprising a microcomputer and the like. Signals from the temperature sensors Th1, Th2, Th3 and Th4, the front door open/close sensor 110 and the sheet type selection key 111 are input to the control section C. Further, the control section C is connected to a relay driving circuit 102 for driving a relay 103 for switching on and off the power to the heater 37H, a motor driving circuit 104 for driving the fixation motor FM and a fan motor driving circuit 105 for driving the fan motor 106. The operations of the relay 103, fixation motor FM and fan motor 106 are controlled by the control section C.

The control section C, the relay driving circuit 102 and the relay 103 constitute power ON/OFF means, while the control section C and the motor driving circuit 104 constitute driving control means for controlling the operation of the fixation motor FM.

Figure 7:
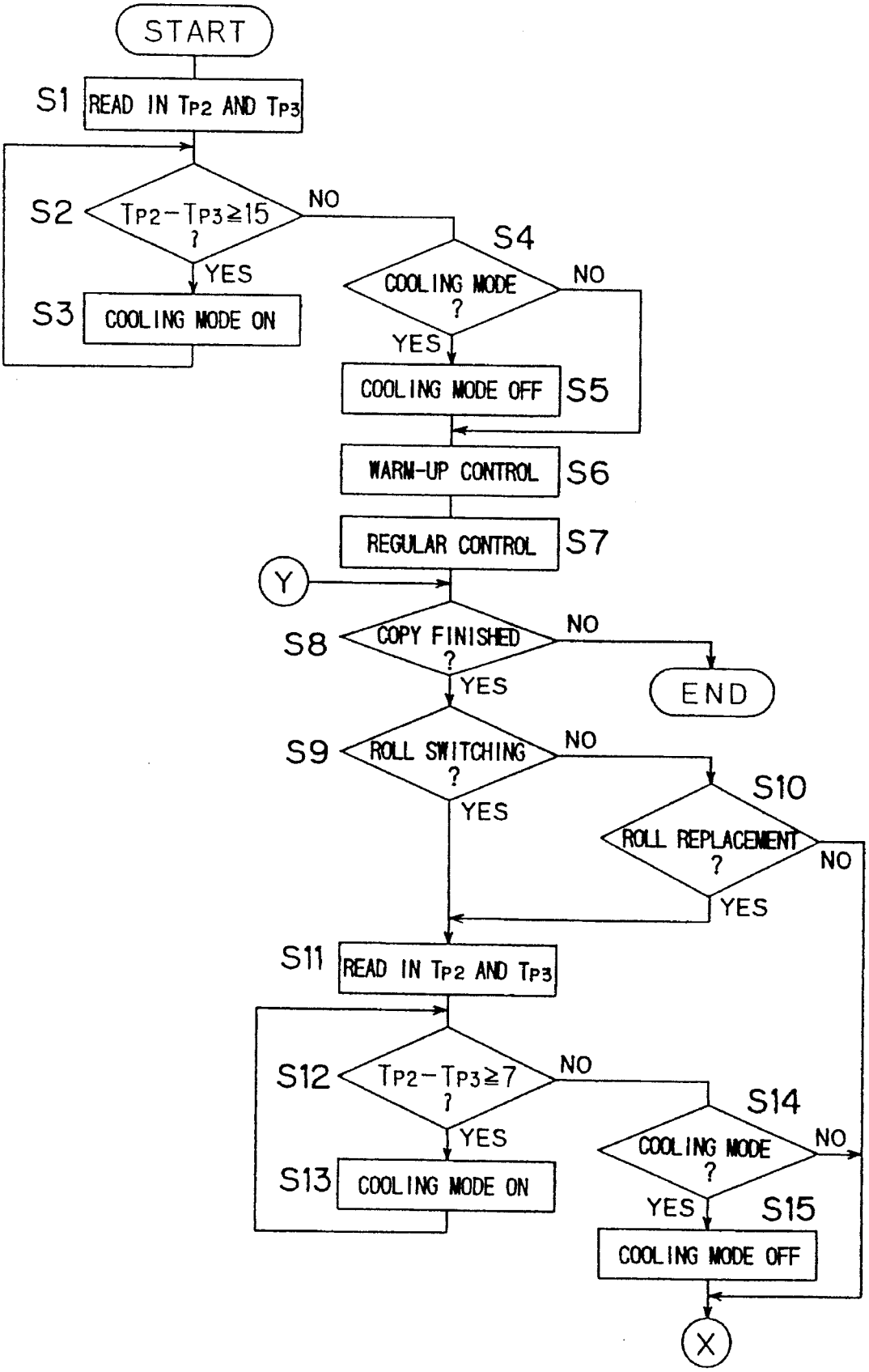
FIG. 7 is a flow chart for a control operation.
Figure 8:
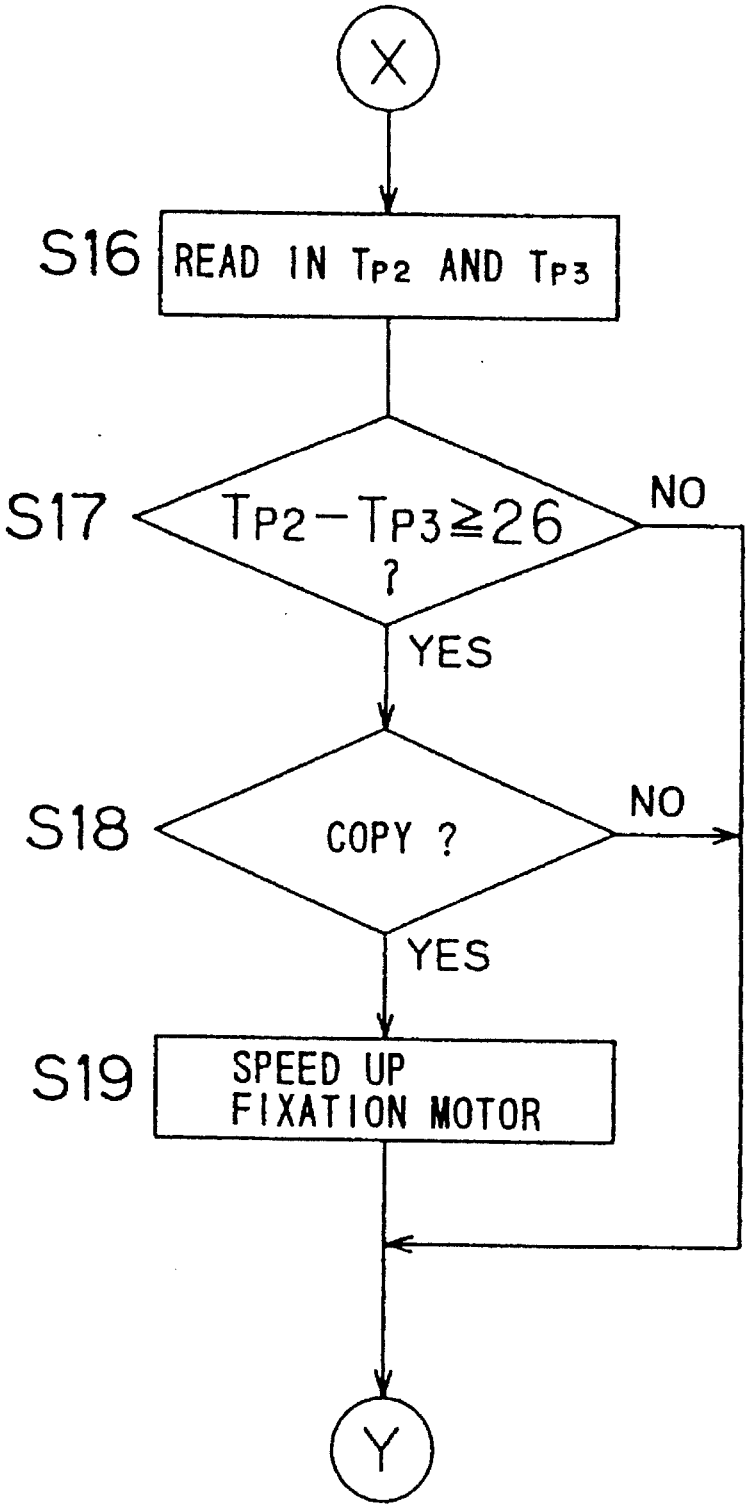
FIG. 8 is a flow chart which is a continuation of the flow chart of FIG. 7.

With reference to flow charts shown in FIGS. 7 and 8, an explanation will next be given to a control operation of the fixation control device.

When a power supply key of the copying machine is switched on to start the operation, a center temperature $T_{p2}$ and an end temperature $T_{p3}$ of the press roller 38 respectively detected by the second temperature sensor Th2 and the third temperature sensor Th3 are read in (Step S1). If a difference ($T_{p2}-T_{p3}$) between the center temperature $T_{p2}$ and the end temperature $T_{p3}$ is equal to or greater than 15° C. (Step S2), a cooling mode is started (Step S3). When the temperature difference becomes less than 15° C. (Step S2), the cooling mode is finished upon condition that the system is in the cooling mode (Steps S4 to S5), and the system performs a warm-up control to steadily rise the temperature of the heat roller 37 to a predetermined temperature at a stretch (Step S6) and then performs a regular control in which the power to the heater 37H is switched on and off to allow the temperature of the heat roller 37 to approach a predetermined control temperature (Step S7). If it is determined in Step S2 that the temperature difference is less than 15° C. immediately after the operation is started, the warm-up control is performed without entering the cooling mode.

In the cooling mode, the cooling fan 107 is driven to supply air at the maximum capacity, and the fixation motor FM and the heater 37H are switched off.

During the regular control, if a roll sheet 4A, 4B or 4C being fed is to be switched to another roll sheet (i.e., a sheet switching signal is input from the sheet type selection key 111) (Step S9), or if a roll sheet 4A, 4B or 4C being fed is to be replaced with a new one (i.e., the front door is opened for replacement of the roll sheet and a front door open signal is input from the front door open/close sensor 110) (Step S10), the center temperature $T_{p2}$ and end temperature $T_{p3}$ of the press roller 38 are read in (Step S11). If the temperature difference ($T_{p2}-T_{p3}$) is equal to or greater than 7° C., the cooling mode is started (Step S13). When the temperature difference becomes less than 7° C., the cooling mode is finished upon condition that the system is in the cooling mode (Steps S14 and S15).

Figure 10:
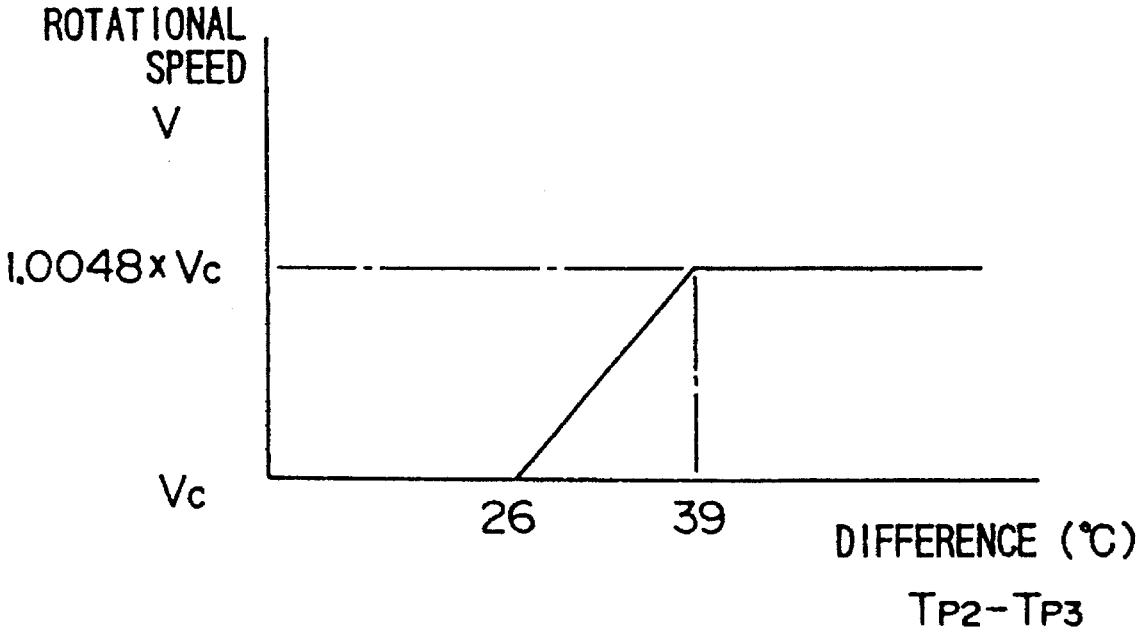
FIG. 10 is a graphical representation illustrating the relationship between the rotational speed of a fixation motor and the temperature difference between the central portion and the end portion of the press roller.

In turn, the center temperature $T_{p2}$ and end temperature $T_{p3}$ of the press roller 38 are read in (Step S16). If the temperature difference ($T_{p2}-T_{p3}$) is equal to or greater than 26° C. (Step S17), the rotational speed V of the fixation motor FM is increased from a reference rotational speed Vc (a usual rotational speed for a copying operation) as shown in FIG. 10 (Steps S18 and S19). That is, the rotational speed V is calculated from the following equations in Step S19:

If 26° C.$\leqq(T_{p2}-T_{p3})\leqq$39° C., $$V=Vc\times\{1+0.48\times(T_{p2}-T_{p3}-26)/13\}$$

If 39° C.$<(T_{p2}-T_{p3})$ $$V=1.48\times Vc$$

The process sequence from Step S8 to Step S19 is repeated, and the process ends when the copying operation is finished (Step S8).

By thus increasing the rotational speed V of the fixation motor FM, the rotational speed of the heat roller 37 and press roller 38 is increased even if the temperature difference ($T_{p2}-T_{p3}$) becomes greater as shown in FIG. 10, thereby compensating the reduction in the transportation ability which would occur due to the thermal expansion of the end portions of the press roller 38. The compensation eliminates the difference in the transportation ability between the heat roller 37/press roller 38 and the transportation rollers 33 provided on the upstream side thereof. Since the sheet 4 or cut-sheet 4D does not slack between the heat roller 37/press roller 38 and the transportation rollers 33 provided on the upstream side thereof, the toner image to be transferred on the transported sheet can be prevented from being offset from the transfer position 20b of the photoreceptor drum 20.

In accordance with this embodiment, the system enters the cooling mode to cool the press roller 38 if the difference ($T_{p2}$–$T_{p3}$) between the center temperature $T_{p2}$ and the end temperature $T_{p3}$ of the press roller 38 becomes greater than the predetermined threshold immediately after the power supply is switched on or after copies are successively made on a plurality of narrow-size sheets. In the cooling mode, the press roller 38 is cooled by the cooling fan 107 in a state where the power to the heater 37H is switched off and the rotation of the heat roller 37 and press roller 38 is stopped to suppress the rise in the temperature of the press roller 38. Thus, the center temperature $T_{p2}$ and the end temperature $T_{p3}$ of the press roller 38 can be kept substantially the same. Therefore, even if a toner image is fixed on a wide-size sheet 4 or 4D after toner fixation is made on the narrow-size sheets, the wrinkling of the wide-size sheet 4 or 4D can be prevented.

In particular, since the system is adapted to enter the cooling mode when a roll sheet 4 being fed is to be replaced with a new one or when a roll sheet 4 being fed is to be switched to another roll sheet, the press roller can be cooled without interfering with the image formation.

To determine whether the system enters the cooling mode or not, the threshold of the temperature difference ($T_{p2}$–$T_{p3}$) to be employed immediately after the power supply is switched on is set to 15° C., which is greater than the threshold (7° C.) for the regular control. This is based on the following ground. Immediately after the power supply is switched on, the heat roller 37 and the press roller 38 are rotatively driven to speedily stabilize the temperatures of the heat roller 37 and press roller 38 (for so-called aging). This may often extremely increase the difference ($T_{p2}$–$T_{p3}$) of the center temperature $T_{p2}$ and the end temperature $T_{p3}$ of the press roller 38 because of temperature imbalance. In such a case, if the threshold is set to a value smaller than the aforesaid value, the system might enter the cooling mode during the aging, thereby making it impossible to rise the temperatures of the heat roller and the press roller to stable levels. This is why the threshold is initially set higher.

It should be understood that various modifications may be made without departing from the spirit and scope of the present invention, as defined in the appended claims.

What is claimed is:

1. A fixation control device comprising:

a fixing unit having a press roller and a heat roller heated by a heater for thermally fixing toner on a sheet passing between the press roller and the heat roller;

driving means for rotatively driving the heat roller and the press roller;

center temperature detection means for detecting the temperature of a longitudinally central portion of the press roller;

end temperature detection means for detecting the temperature of an end portion of the press roller; and control means for controlling the driving means based upon a comparison of the temperature detected by the center temperature detection means with the temperature detected by the end temperature detection means to control the rotational speed of the heat roller and press roller.

2. A fixation control device as set forth in claim 1, wherein the control means controls the driving means to rotate the heat roller and the press roller at a rotational speed higher than usual when a difference between the temperature detected by the center temperature detection means and the temperature detected by the end temperature detection means is greater than a predetermined threshold.

3. A fixation control device as set forth in claim 2, wherein the rotational speed is increased as the temperature difference increases.

4. A fixation control device as set forth in claim 3, wherein when the temperature difference is greater than the threshold by not less than a predetermined amount, the rotational speed is kept constant regardless of the increase in the temperature difference.

5. A fixation control device as set forth in claim 1, further comprising:

cooling means for supplying air to the press roller to cool the press roller;

wherein if conditions including that the difference between the temperature detected by the center temperature detection means and the temperature detected by the end temperature detection means is greater than a predetermined threshold are satisfied, the control means selects a cooling mode in which the cooling means is driven in a state where power to the heater is switched off and the driving of the driving means is stopped.

6. A fixation control device as set forth in claim 5, wherein the sheet includes a plurality of roll sheets to be respectively fed out of corresponding rolls;

wherein the conditions include that a signal indicative of replacement of any of the rolls is input.

7. A fixation control device as set forth in claim 5, wherein the sheet includes a plurality of roll sheets to be respectively fed out of corresponding rolls;

wherein the conditions include that a signal indicative of switching of the rolls is input.

8. A fixation control device as set forth in claim 7, further comprising:

front door open state detection means for detecting an open state of a front door of a body of an image forming apparatus;

wherein the signal indicative of the roll switching is an open state detection signal applied from the front door open state detection means.

9. A fixation control device as set forth in claim 5, wherein the threshold to be set during a predetermined time period after power supply is switched on is greater than that to be set thereafter.

* * * * *